US011073798B2

(12) United States Patent
Cettour-Baron et al.

(10) Patent No.: US 11,073,798 B2
(45) Date of Patent: Jul. 27, 2021

(54) GUIDE BEARING FOR A TIMEPIECE BALANCE PIVOT

(71) Applicant: ROLEX SA, Geneva (CH)

(72) Inventors: Raphaël Cettour-Baron, Messery (FR); Olivier Hunziker, Vevey (CH); Léonard Testori, Nyon (CH)

(73) Assignee: ROLEX SA, Geneva (CH)

( * ) Notice: Subject to any disclaimer, the term of this patent is extended or adjusted under 35 U.S.C. 154(b) by 51 days.

(21) Appl. No.: 15/935,609

(22) Filed: Mar. 26, 2018

(65) Prior Publication Data

US 2018/0284698 A1 Oct. 4, 2018

(30) Foreign Application Priority Data

Mar. 30, 2017 (EP) ..... 17163973

(51) Int. Cl.
*G04B 31/02* (2006.01)
*G04B 31/04* (2006.01)
*G04B 31/00* (2006.01)

(52) U.S. Cl.
CPC ..... *G04B 31/04* (2013.01); *G04B 31/00* (2013.01); *G04B 31/02* (2013.01)

(58) Field of Classification Search
CPC ..... G04B 31/02; G04B 31/04; G04B 31/00; G04B 15/18; G04B 15/188
See application file for complete search history.

(56) References Cited

U.S. PATENT DOCUMENTS 1,845,430 A * 2/1932 Fritz Marti ..... G04B 31/02 384/215
1,976,181 A * 10/1934 Fritz ..... G04B 31/02 368/326
2,621,469 A * 12/1952 Erismann ..... G04B 31/04 368/326
2,654,990 A * 10/1953 Le Van ..... G04B 31/0082 368/324
2,919,961 A * 1/1960 Roger Matthey ..... G04B 31/02 384/225
3,790,327 A * 2/1974 Haberle ..... B29C 48/288 425/379.1
3,941,439 A * 3/1976 Piguet ..... G04B 31/02 384/125

(Continued)

FOREIGN PATENT DOCUMENTS

CH 239786 A 11/1945
CH 272618 A 12/1951

(Continued)

OTHER PUBLICATIONS

European Search Report and Written Opinion dated Oct. 11, 2017 issued in counterpart application No. EP17163973; w/ English machine translation (16 pages).

(Continued)

*Primary Examiner* — Sean Kayes
(74) *Attorney, Agent, or Firm* — Westerman, Hattori, Daniels & Adrian, LLP

(57) ABSTRACT

A bearing (1*a*) for guiding a timepiece shaft about an axis, notably a guide bearing for a portion of a timepiece resonator shaft, comprising at least one pressing element (13*a*) arranged in such a way as to constantly exert an action on the shaft, radially or substantially radially with respect to the axis.

25 Claims, 7 Drawing Sheets

(56) References Cited

U.S. PATENT DOCUMENTS

| | | | | |
|---|---|---|---|---|
| 4,358,166 | A | 11/1982 | Antoine | |
| 7,926,355 | B2 * | 4/2011 | Bannier | G04B 13/023 73/760 |
| 9,164,482 | B2 | 10/2015 | Villaret | |
| 9,292,005 | B2 * | 3/2016 | Hessler | G04B 31/004 |
| 9,678,477 | B2 * | 6/2017 | Tanabe | G04B 13/02 |
| 9,684,283 | B2 * | 6/2017 | Stranczl | G04B 31/06 |
| 9,880,522 | B2 * | 1/2018 | Hessler | G04B 31/004 |
| 2009/0263182 | A1 * | 10/2009 | Bannier | G04D 7/04 403/242 |
| 2011/0080810 | A1 | 4/2011 | Hiraoka et al. | |
| 2014/0056112 | A1 | 2/2014 | Villaret | |
| 2014/0341005 | A1 * | 11/2014 | Hessler | G04B 31/02 368/326 |
| 2015/0003215 | A1 * | 1/2015 | Hessler | G04B 31/004 368/131 |
| 2016/0026154 | A1 | 1/2016 | Courvoisier | |
| 2016/0041526 | A1 * | 2/2016 | Stranczl | G04B 31/02 368/326 |
| 2016/0077491 | A1 * | 3/2016 | Tanabe | G04B 13/02 368/322 |
| 2017/0115637 | A1 | 4/2017 | Egli et al. | |
| 2017/0205768 | A1 | 7/2017 | Renaud | |

FOREIGN PATENT DOCUMENTS

| | | | |
|---|---|---|---|
| CH | 439778 | A | 7/1967 |
| CH | 700 496 | B1 | 9/2010 |
| CH | 701 075 | B1 | 11/2010 |
| CH | 701 995 | A2 | 4/2011 |
| CH | 704 770 | A2 | 10/2012 |
| CH | 709 905 | A2 | 1/2016 |
| EP | 2 112 565 | A1 | 10/2009 |
| EP | 2469358 | A2 | 6/2012 |
| EP | 2 701 014 | A1 | 2/2014 |
| EP | 2 945 028 | A1 | 11/2015 |
| EP | 2948820 | A1 | 12/2015 |
| EP | 2 977 829 | A1 | 1/2016 |
| EP | 3163384 | A1 | 5/2017 |
| FR | 2398348 | A1 | 2/1979 |
| GB | 1119814 | A | 7/1968 |
| WO | 2014/114377 | A1 | 7/2014 |

OTHER PUBLICATIONS

EPO third party observations dated Apr. 8, 2019 in counterpart application No. EP17163973; with English machine translation (7 pages) ,(PL3, EP2977829 and NP4, EP2701014 are not listed in this IDS since they were already listed in the IDS filed Mar. 16, 2018).

* cited by examiner

GUIDE BEARING FOR A TIMEPIECE BALANCE PIVOT

This application claims priority to European patent application No. EP17155907.3 filed Feb. 13, 2017, which is hereby incorporated by reference herein in its entirety.

The invention relates to a bearing for guiding the rotation of a timepiece shaft, notably to a guide bearing for a timepiece shaft portion or resonator pivot, particularly a guide bearing for a timepiece balance pivot-shank. The invention also relates to a horology shock-absorber or shock-absorber device comprising such a bearing. The invention also relates to a horology mechanism comprising such a bearing or such a shock-absorber. The invention also relates to a horology movement comprising such a bearing or such a shock-absorber or such a mechanism. The invention also relates to a timepiece comprising such a bearing or such a shock-absorber or such a mechanism or such a movement.

Conventional balance guide bearings or pivot devices introduce friction into the balance pivots, the magnitude of which friction varies according to the position of the oscillator. In general, friction is higher when the watch is in a vertical position, also referred to as a "hanging" position, than when the watch is in a horizontal position or "flat" position, which means that the amplitude of oscillation of the balance is lower when the watch is in the vertical positions than when it is in the horizontal positions. A difference in amplitude may notably manifest itself in a difference in running, hence the importance to the precision of the timepiece of minimizing the "flat-hanging" difference, namely the difference in running between the "flat" position and the "hanging" position.

Within conventional balance pivot devices, friction in the various positions varies because the configurations of the contact between the balance pivots and the guide jewels change. When the watch is in a horizontal position, the balance staff is vertical and the tip of the shaft pivot presses against a jewel known as an endstone. In general, this jewel is planar and the tip of the pivot is rounded, which means that the radius of the friction surface is small and the resulting friction is low. When the watch is in a vertical position, the balance staff is in a horizontal position and rubs against the edge of a hole, generally an olived hole and/or a hole with rounded edges formed in a jewel. Friction is higher and the amplitude of oscillation of the balance is therefore lower than when the watch is in a horizontal position.

Document CH239786 discloses a pivot device combining an olived jewel and an endstone banking that is inclined with respect to the shaft. This means that friction between the cylindrical part of the shaft and the olived jewel can be constantly created when the watch is in a horizontal position, thus increasing friction in this position.

Document U.S. Pat. No. 2,654,990 discloses a flat-tipped pivot with slightly rounded edges rubbing against an endstone equipped with a hemispherical depression. The objective here again is to increase friction when the watch is in a horizontal position by maximizing the rubbing radius of the pivot contact surface in such a position.

Following the same pattern, patent application CH704770 proposes a pivot ending in a chamfer with a view to increasing friction when the watch is in a horizontal position.

Because of the pivoting clearances, notably radial clearances, the abovementioned embodiments give rise to various configurations of contact between pivot and jewel according to the position of the watch.

Differences in running between the horizontal and vertical positions therefore remain.

Single-piece shock-absorbers in which the means of pivoting of the balance pivot are manufactured as a single piece with the return means are also known. For example, document CH700496 relates to a simplified one-piece shock-absorber in which the balance pivot bushing guide means are embodied by means for elastically returning the shock-absorber body. During conventional timepiece operation, these elastic return means press the pivot bushing firmly against a banking formed by the body of the shock-absorber such that they have no effect on the balance pivot. Furthermore, no information as to the chronometric performance of such a device is given.

Document CH701995 relates to a bearing which exhibits the particular feature of being pressed firmly against a balance pivot under the effect of a spring designed to apply a force directed axially relative to the balance pivot staff. The bearing and the spring are preassembled within a pivot structure ready to be mounted on the horology movement. The objective is to eliminate movements of the pivot and, therefore, variations in the configuration of contact between the pivot and the bearing as a result of changes in the position of the watch. Thus, when the timepiece is in operation, the spring is preloaded in such a way that it can act on the balance pivot, unlike the anti-shock spring of a conventional shock-absorber which acts only by reaction in the event of a shock under the effect of the longitudinal movement of the balance pivot. In preferred embodiments, the spring has a geometry similar to that of an anti-shock spring. As an alternative, the spring may take the form of a helical spring. It is also mentioned that the bearing and the spring can be made as a single piece. Such a solution is not optimal insofar as the spring preload is dependent on the axial location of the pivoting structure, and therefore notably on numerous assembly tolerances. Document CH701995 also discloses means for adjusting the spring preload by moving the pivot structure axially, for example through the agency of a bearing body the exterior periphery of which is threaded so that it can collaborate with a tapping made on a balance bridge. Furthermore, it is also indicated that the force produced by the spring is rated in such a way that it allows the pivot device to behave appropriately in the event of a shock. The pivoting and shock-absorbing functions are therefore dependent on one another.

Patent application CH709905 discloses various embodiments of bladed pivots. In one alternative form of embodiment, two blades supported by a balance are kept pressed against the bottoms of grooves under the effect of elastically deformable arms. Such a structure entails a complex construction, defining two distinct virtual pivot shafts. In alternative forms of embodiment, blades returned by elastically deformable arms may define one and the same virtual axis of pivoting, but need to be arranged in distinct planes. Such embodiments are likewise not well suited to a conventional balance structure. In particular, the amplitude of oscillation on such pivots is very limited.

The object of the invention is to provide a guide bearing that makes it possible to overcome the aforementioned disadvantages and to improve the horology bearings known from the prior art. In particular, the invention proposes a guide bearing of simple structure that also makes it possible to minimize the discrepancy that exists between the torques resisting oscillation of a resonator in the various horology device positions.

A guide bearing according to the invention is defined by point 1 below.

1. A bearing for guiding a portion of a timepiece resonator shaft about an axis, comprising at least one pressing element arranged in such a way as to constantly exert an action on the shaft, radially or substantially radially with respect to the axis.

Various embodiments of the bearing are defined by points 2 to 11 below.

2. The bearing as defined in the preceding point, wherein it comprises at least one return element collaborating with the at least one pressing element.

3. The bearing as defined in the preceding points, wherein the at least one return element and the at least one pressing element are made as one piece.

4. The bearing as defined in one of the preceding points, wherein it comprises at least two pressing elements for pressing on the shaft about the axis.

5. The bearing as defined in one of the preceding points, wherein it comprises at least two return elements, notably three return elements, and at least as many pressing elements.

6. The bearing as defined in one of the preceding points, wherein each of the at least one pressing element comprises at least one planar or concave or convex pressing surface, notably all the pressing surfaces being planar or concave or convex.

7. The bearing as defined in one of the preceding points, wherein it comprises at least one blade, notably three blades, or even more than three blades, each one constituting:

at least one pressing element for pressing on the shaft, and a return element for returning the at least one pressing element to press on the shaft.

8. The bearing as defined in the preceding point, wherein:

the blade or blades extend parallel or substantially parallel to the pressing elements in the vicinity of the pressing elements and/or orthogonally or substantially orthogonally with respect to the axis in the vicinity of the pressing elements, or wherein the blade or blades extend at least substantially perpendicular to the pressing elements in the vicinity of the pressing elements and/or orthogonally or substantially orthogonally with respect to the axis in the vicinity of the pressing elements.

9. The bearing as defined in point 7 or 8, wherein the blade or blades extend at least substantially in a straight line or wherein the blade or blades extend in curves, notably at least substantially in spirals.

10. The bearing as defined in one of points 1 to 6, wherein it comprises at least one radial or substantially radial protuberance, each protuberance comprising:

at least one pressing element for pressing on the shaft, and a return element for returning at least one pressing element to press on the shaft.

11. The bearing as defined in one of the preceding points, wherein it comprises an annular chassis, the pressing elements being mechanically connected to the chassis via the return elements and/or wherein the annular chassis is manufactured as a single piece or produced in several independent components, notably in as many independent components as there are return elements and/or wherein it comprises bankings limiting the deformation of the return elements and/or wherein the pressing elements and/or the return elements are uniformly angularly distributed about the axis.

A shock-absorber according to the invention is defined by point 12 below.

12. A shock-absorber comprising a bearing as defined in one of the preceding points and an endstone jewel.

A mechanism according to the invention is defined by point 13 below.

13. A horology mechanism, notably a balance oscillator, comprising at least one bearing as defined in one of points 1 to 11 or a shock-absorber as defined in the preceding point and a shaft mounted in the at least one bearing.

One embodiment of the bearing is defined by point 14 below.

14. The mechanism as defined in the preceding point, wherein the mechanism comprises a resonator comprising a balance and/or wherein the mechanism comprises a resonator of which a shaft portion or pivot-shank is guided by the bearing and/or wherein the at least one return element is preloaded.

A movement according to the invention is defined by point 15 below.

15. A horology movement comprising at least one bearing as defined in one of points 1 to 11 or a shock-absorber as defined in point 12 or a mechanism as defined in point 13 or 14.

A timepiece according to the invention is defined by point 16 below.

16. A timepiece, notably a wristwatch, comprising a movement as defined in the preceding point or a mechanism as defined in points 13 or 14 or a shock-absorber as defined in point 12 or at least one bearing as defined in one of points 1 to 11.

The attached figures depict, by way of examples, embodiments of a timepiece according to the invention.

Figure 1:
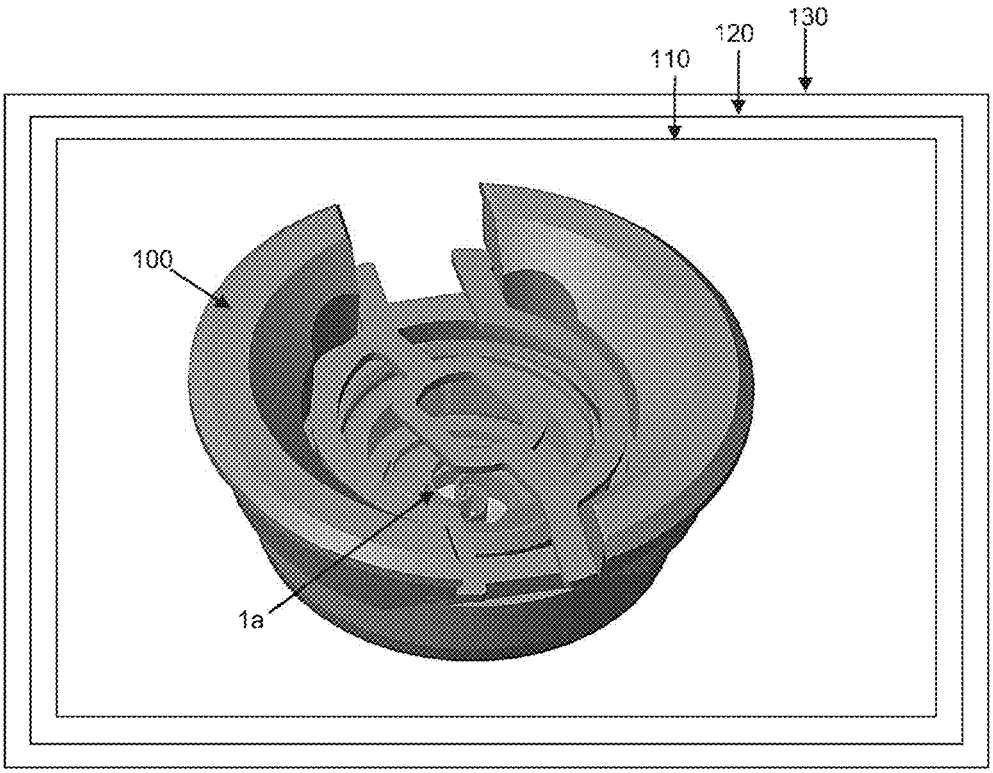
FIG. 1 is a schematic view of one embodiment of a timepiece comprising a first embodiment of a guide bearing.

One embodiment of a timepiece 130 is described hereinafter with reference to FIG. 1. The timepiece is, for example, a watch, particularly a wristwatch.

The timepiece comprises a horology movement 120, notably a mechanical horology movement.

The movement comprises a horology mechanism 110, notably an oscillator connected to a power source, such as a mainspring barrel, by a going train. The oscillator comprises a resonator, notably a resonator of the balance-wheel and hairspring type. The resonator comprises a shaft 2 (depicted, for example, schematically in FIGS. 3 and 4), for example a balance staff.

The mechanism comprises at least one guide bearing, notably at least one bearing 1*a*; 1*b*; 1*a*'; 1*b*'; 1*c*' for guiding the rotation of the resonator, on a shaft portion. This at least one bearing advantageously forms part of a shock-absorber 100 forming part of the mechanism. For preference, to guide the rotation of the resonator, the mechanism comprises two shock-absorbers 100, each one comprising a resonator guide bearing. As a preference, the resonator is pivoted on each side of the shaft 2 by two bearings. Advantageously too, mounting the resonator shaft in the guide bearing causes elastic deformation of at least part of the bearing. It then follows that once the shaft has been mounted in the guide bearing, the latter is preloaded.

Advantageously the shock-absorber or shock-absorbers 100 comprise an endstone jewel returned to a stable position by the action of a spring and capable of being moved axially relative to the axis of the resonator against the action of the spring in the event of a shock or of acceleration that moves the resonator against this endstone jewel. The spring known as the anti-shock spring is designed to absorb the forces of the resonator shaft via the endstone jewel, the function of which is to delimit the shake, notably the axial shake, of the resonator shaft. In the event of a shock, the forces experienced by the shaft are absorbed by the anti-shock spring via the endstone jewel. In conventional timepiece operation, the anti-shock spring presses the endstone jewel and the pivot jewel firmly against a banking predefined by the body of the shock-absorber so that the anti-shock spring has no axial effect on the resonator shaft. In this way, the resonator shaft is mounted with axial clearance within the shock-absorber.

The shock-absorber or shock-absorbers 100 may comprise a pivot jewel. When that is the case, the resonator, in the event of a shock or acceleration that moves the resonator radially relative to the axis of the resonator against the action of the guide bearing, may come into abutment against this pivot jewel after the bearing has been deformed to a certain extent.

Alternatively, it is possible for the shock-absorber or shock-absorbers 100 not to comprise a pivot jewel. When that is the case, the guide bearing 1*a*; 1*b*; 1*a*'; 1*b*'; 1*c*' may take the place of the pivot jewel of a shock-absorber known from the prior art.

In general, the guide bearing 1*a*; 1*b*; 1*a*'; 1*b*'; 1*c*' guides the shaft 2, notably the resonator shaft, along an axis 21. The bearing comprises at least one pressing element 13*a*; 13*b*; 131*a*; 132*a*; 13*a*'; 13*b*'; 13*c*' arranged in such a way as to constantly exert an action on the shaft, particularly a force on the shaft, radially or substantially radially with respect to the axis. However, the action may be inclined with respect to the direction radial to the shaft 21 as a result of the coefficient of friction at the pressing-element/shaft interface.

For preference, the action or actions are exerted perpendicularly to the axis 21 of the shaft. The rotational-guidance function may therefore be dissociated from the function of absorbing axial loads.

For example, the direction of the action or actions forms an angle of less than 20° or less than 10° or less than 5° with a plane perpendicular to the axis 21.

What is meant by "constantly exert" is that the action or actions are exerted constantly over time, when the resonator is in place in the rest of the movement, regardless of the position of the movement in space, notably regardless of the position of the resonator in space. Contact between a pressing element and the shaft may nevertheless be temporarily interrupted when the movement is subjected to an acceleration above a predefined threshold, for example a threshold of the order of 1 g which corresponds to the strength of the earth's gravitational field, notably a threshold of between 0.1 g and 1 g. Such a threshold range advantageously allows the bearing to be rated optimally with regard to energy considerations, notably with regard to the friction induced by the bearing against the shaft. The acceleration threshold may, nevertheless, be set at any other value, notably for preference at any other value greater than or equal to 1 g, notably of the order of 2 g.

Advantageously, the intensity of the torque resisting movement of the resonator as a result of the action or actions exerted by the at least one pressing element on the shaft is constant or substantially constant, particularly constant over time, when the resonator is in place in the rest of the movement and when the resonator is in motion, regardless of the position of the movement in space, notably regardless of the position of the resonator in space. Advantageously, the intensity of the action or actions exerted by the at least one pressing element on the shaft is constant or substantially constant, particularly constant over time, once the resonator is in place in the rest of the movement, regardless of the position of the movement in space, notably regardless of the position of the resonator in space.

The shaft portion guided by the bearing may be a pivot or a pivot-shank. The pivot may notably exhibit a cylindrical or frustoconical cross section.

For preference, the bearing comprises at least one return element 12*a*; 12*b*; 12*a*'; 12*b*'; 12*c*' collaborating with the at least one pressing element. Thus, it is the at least one return element 12*a*; 12*b*; 12*a*'; 12*b*'; 12*c*' which returns the at least one pressing element 13*a*; 13*b*; 131*a*; 132*a*; 13*a*'; 13*b*'; 13*c*' into contact with the shaft 2. This at least one return element is advantageously elastically deformable. Thus, the return force for returning the at least one pressing element to press on the shaft is produced by the elastic deformation of the at least one return element. The at least one return element is defined or engineered in such a way as to ensure that the contact is constant as long as the acceleration experienced by the timepiece remains below the acceleration threshold described hereinabove.

In a first embodiment described hereinafter with reference to FIGS. 2 to 6, the bearing comprises at least one curved blade 14*a*, notably three curved blades, or even more than three curved blades, notably four or five curved blades, each one constituting:

- at least one pressing element 13*a* for pressing on the shaft, and
- a return element 12*a* for returning the at least one pressing element to press on the shaft.

For preference, the blades are curved into the shape of a spiral. The spiral may notably be such that it is defined by a polar equation in which the radius is proportional to the angle or in which the radius is proportional to the angle raised to a power. As another alternative, the blades may have any arbitrary shape provided that they exhibit suitable stiffness. They may have a zig-zag, straight or curved shape. The blades may be curved through more than 180°, notably through around 270°, between their two ends. The curved shapes of the blades make it possible to optimize the space they occupy for a given size so as to obtain mechanical load characteristics in the blades and blade stiffness characteristics that are suited to the application. The shapes of the blades may be planar (notably in a plane perpendicular to the axis of the bearing). The shapes of the blades may also be nonplanar. Thus, it is possible to increase the active lengths of the blades.

Figure 2:
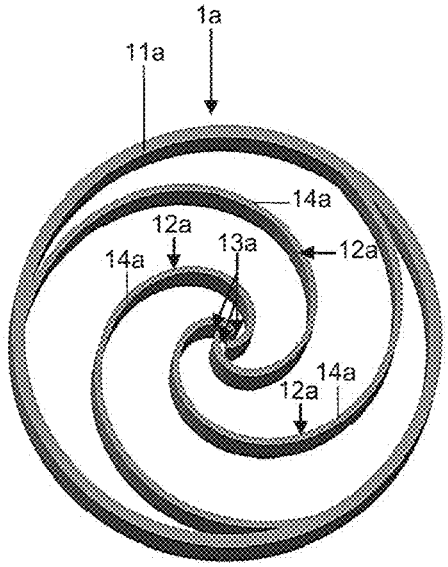
FIG. 2 is a perspective view of a first alternative form of the first embodiment of the guide bearing.

In a first alternative form of the first embodiment described hereinafter with reference to FIGS. 2 to 4, the bearing chiefly comprises a chassis 11*a*, notably an annular chassis, and blades 14*a* extending toward the inside of the chassis, notably three blades. The blades extend, for example, from an internal surface of the annular chassis. Each blade has a convex face and a concave face. A first end of each blade is attached or fixed to the chassis. A second end of each blade is free. In the vicinity of these free second ends, the concave faces may form the pressing elements for pressing on the shaft. Each pressing element is, for example, a portion of a concave face in the vicinity of a free end of a blade. In the alternative form depicted, the pressing elements are formed at the face portions by concave surfaces. The radii of curvature of these concave surfaces are greater than the radius of the shaft 2 that the bearing is intended to accept. For example, the radii of curvature of these concave surfaces at the level of the pressing elements are greater than five times the radius of the shaft 2 that the bearing is intended to accept.

Each pressing element is mechanically connected to the chassis via a return element. This return element consists of that part of the blade that separates:

the concave-face portion that constitutes the pressing element from the chassis.

The diameter of the internal face of the chassis may represent 30 times or even 40 times the diameter of the shaft 2.

Figure 5:
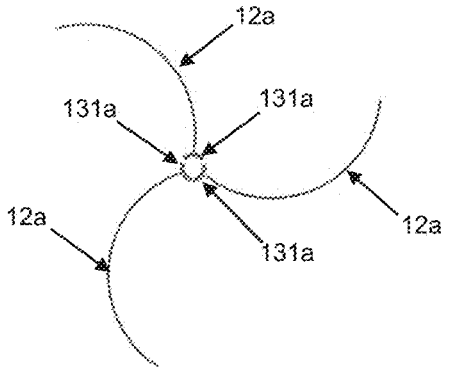
FIG. 5 is a schematic view of a second alternative form of the first embodiment of the guide bearing.

In a second alternative form of the first embodiment described hereinafter with reference to FIG. 5, the bearing differs from the bearing described in the first alternative form of the first embodiment in that the pressing elements 131*a* extend perpendicularly or substantially perpendicularly with respect to the free ends of the blades in a plane perpendicular to the axis 21. Thus, the pressing elements 131*a* in this alternative form are cylinder portions arranged perpendicularly or substantially perpendicularly with respect to the free ends of the blades. Such a configuration notably favors the positioning and stability of the pivot relative to the bearing. Thus it can be guaranteed that the axis 21 of the shaft 2 remains in a defined vicinity of the position in which it is centered in the bearing even under the effect of significant loadings on the resonator.

Figure 6:
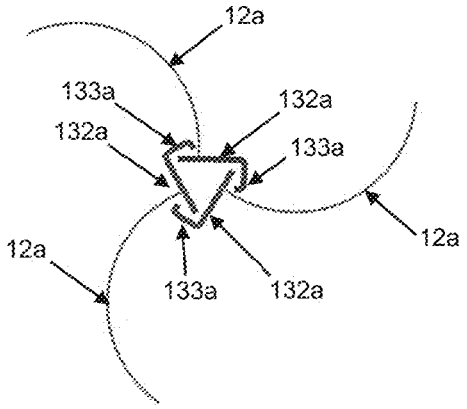
FIG. 6 is a schematic view of a third alternative form of the first embodiment of the guide bearing.

In a third alternative form of the first embodiment described hereinafter with reference to FIG. 6, the bearing differs from the bearing described in the second alternative form of the first embodiment in that the pressing elements 132*a* comprise bankings or hooks 133*a* designed to limit the deformations of the return elements 12*a*. Thus it may be guaranteed that the axis 21 of the shaft 2 remains in a defined vicinity of the position in which it is centered in the bearing even under the effect of significant loadings on the resonator. This then avoids any risk of breakage of the blades as the bearing is being assembled, particularly as the shaft 2 is being fitted into the bearing, or during operation of the movement when the resonator is in motion. The bankings are, for example, formed by arms extending substantially perpendicularly with respect to the surfaces of the pressing elements which press against the shaft. These bankings are intended to collaborate with another adjacent pressing element of the bearing. In FIG. 6, the various elements are depicted in a configuration in which the bankings are inactive, namely a configuration in which they are not collaborating through contact with an adjacent element.

In a second embodiment described hereinafter with reference to FIGS. 7 to 10, the bearing differs from the bearing described in the first embodiment in that the blades 14*b* are straight or rectilinear (rather than curved). In addition, in this embodiment, the surfaces of the pressing elements that are in contact with the shaft 2 are planar. The flexible blades therefore take the form of straight beams. Their cross sections may be constant.

In this embodiment, the bearing comprises bankings limiting the deformation of the return elements. Specifically, the blades remain in proximity to surfaces 16 of the chassis constituting bankings. When the deformation of a return element reaches a certain degree, the blade comes into contact with this banking and its deformation is thus limited. This then avoids any risk of breakage of the blades during assembly of the bearing, particularly as the shaft 2 is being fitted into the bearing, or during operation of the timepiece when the resonator is in motion, notably in the event of a shock.

Whatever the alternative form from among the first two embodiments, the return elements consist of part of a flexible blade. For preference, the various flexible blades are formed as one single component thus forming a one-piece bearing including the chassis.

Whatever the alternative form from among the first two embodiments, the resonator shaft can be pivoted between the flexible blades. Whatever the position of the resonator, the blades, particularly the pressing elements, are pressed firmly against the shaft under the effect of their respective preload. Specifically, the blades, particularly the return elements, are elastically deformed when the shaft is introduced into the bearing. This elastic deformation leads to a return force which has a tendency to return the blades to their original position as the shaft is introduced.

Figure 3:
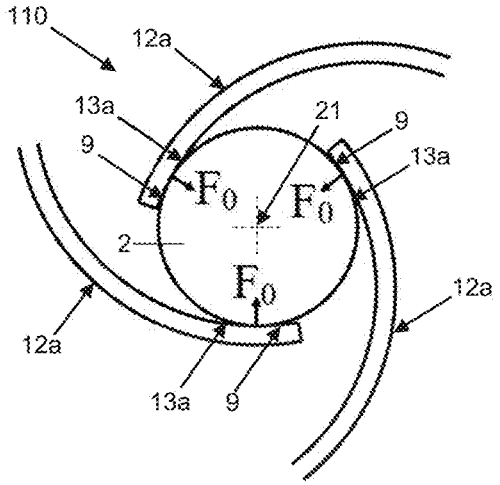
FIGS. 3 and 4 are partial views of the first alternative form of the first embodiment of the guide bearing, a balance staff being guided by the bearing.
Figure 4:
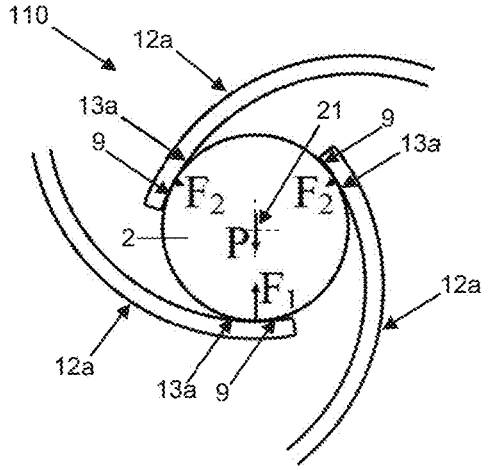

As depicted in FIG. 3, when the watch is in the horizontal position (position in which the axis 21 is vertical), each of the blades exerts the same force, ideally minimized as far as possible, on the shaft. Ideally, this force is suited to inducing friction substantially equal to the friction that acts in the vertical position. Contact between the blades and the shaft can be temporarily interrupted when the movement is subjected to an acceleration above a predefined threshold. A threshold that may be comprised between 0.5 g and 1 g advantageously means that the friction of the blades against the shaft can be minimized as far as possible.

When the watch is in a horizontal position, the weight of the shaft is theoretically not absorbed by the bearing. The weight is, for example, absorbed by an endstone jewel. As depicted in FIG. 4, when the watch is in a vertical position (position in which the axis 21 is horizontal), the weight of the resonator is absorbed by the blade or blades of the bearing. This causes a small movement (perpendicular to the axis 21). This movement is advantageously similar to or lower than those known in conventional bearings. As a result of this movement, the blade or blades situated above the shaft exert a lower force on the shaft than those situated underneath. As long as all the blades remain in contact with the shaft, the sum of the intensities of the loads of the blades on the shaft remains essentially the same regardless of the position of the resonator. When the resonator is mobile within the movement, the intensity of the friction torque resulting from the loads of the blades on the shaft therefore essentially also remains the same whatever the position of the resonator. This has the effect of balancing the quality factors of the resonator between the various horology device positions.

Figure 10:
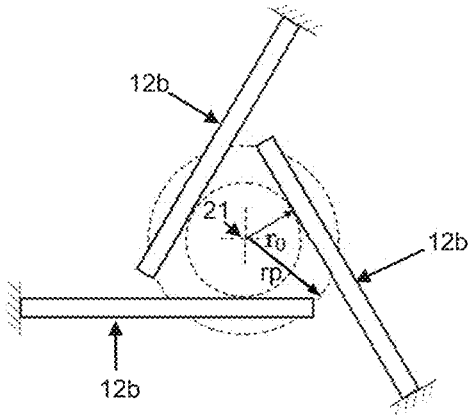
FIG. 10 is a schematic view of the second embodiment of the guide bearing, without the balance staff guided by the bearing.

FIG. 10 depicts a bearing partially, without the shaft mounted in the bearing. In that configuration, the three blades define an inscribed circle of radius r0.

As the shaft is mounted in the bearing, the flexible blades are elastically deformed, namely preloaded, over a distance rp-r0, rp being the radius of the shaft at the point at which the blades press against the shaft.

The preloading force F0 of each of the flexible blades is thus given by:

F0=k. (rp-r0) where k is the stiffness of each of the flexible blades.

Studies based on static force balancing show that the static friction torque C induced by the flexible blades against the shaft of the resonator is constant or substantially constant whatever the position of the resonator in space, and that this torque is essentially dependent on:

this preload force F0 (as long as it is strictly positive at each of the blades), the coefficient of friction η between the shaft and each of the flexible blades, and the radius rp of the shaft.

Thus, the static friction torque C, whatever the position of the resonator, is equal or substantially equal to the static friction torque CH induced by the flexible blades against the shaft of the resonator when the watch is in a horizontal position (shaft 2 and axis 21 oriented vertically). In this configuration, depicted in FIG. 9 (and assuming that the weight P is oriented exclusively along the axis of rotation of the shaft), of the resonator, the torque CH can be expressed as follows:

CH=3.η.F0.rp or CH=3.η.k(rp-r0).rp

Thus:

C=3.η.F0.rp or C=3.η.k(rp-r0).rp

Because this value C is constant or substantially constant whatever the position of the watch, it therefore has the effect of balancing the quality factors of the oscillator between the various positions.

Figure 7:
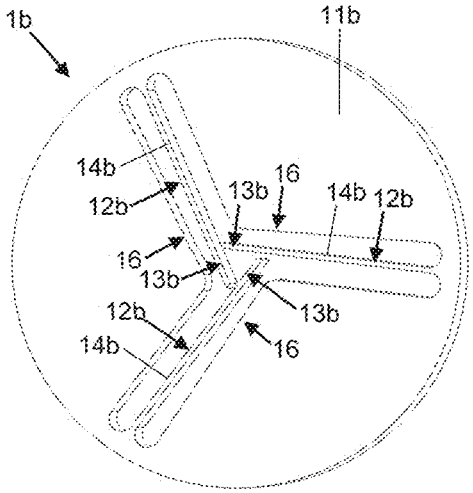
FIG. 7 is a perspective view of a second embodiment of the guide bearing.
Figure 8:
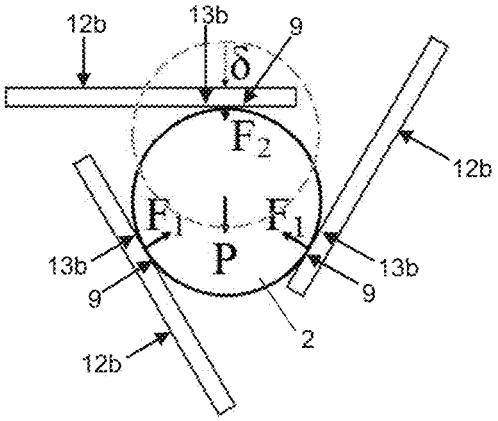
FIGS. 8 and 9 are schematic views of the second embodiment of the guide bearing, a balance staff being guided by the bearing.
Figure 9:
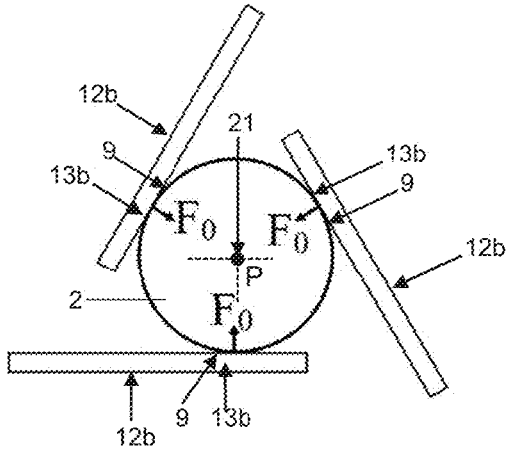
Figure 17:
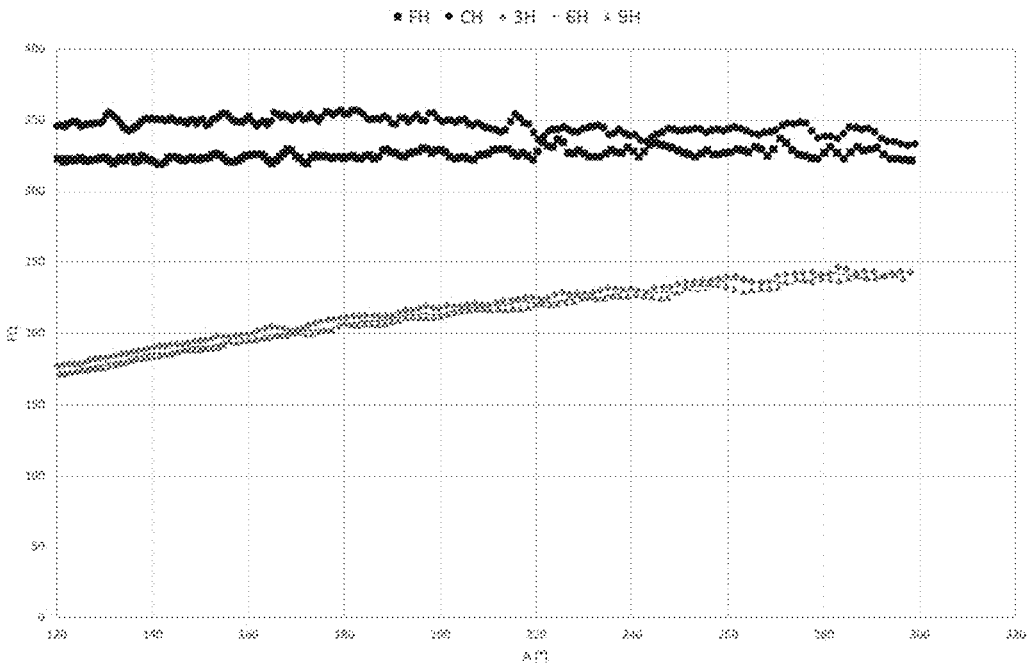
FIG. 17 is a graph illustrating, for the various horology device positions, the changes in the quality factor FQ of a resonator the balance of which is guided by a bearing according to the prior art, as a function of the amplitude A of the resonator oscillations.
Figure 18:
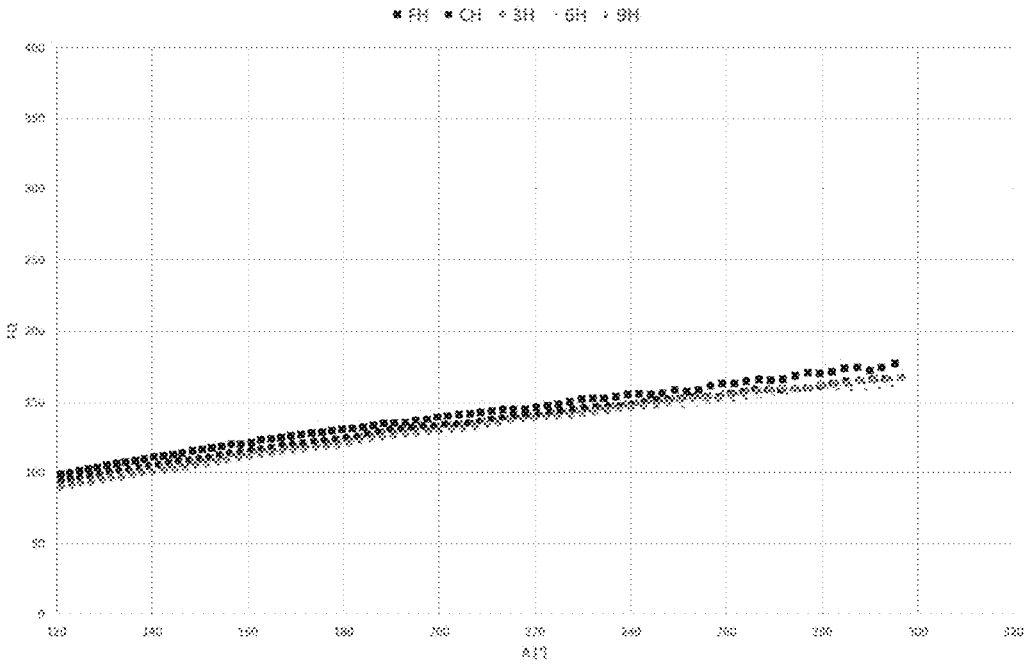
FIG. 18 is a graph illustrating, for the various horology device positions, the changes in the quality factor FQ of a resonator the balance of which is guided by a bearing according to the second embodiment, as a function of the amplitude A of the resonator oscillations.

By way of example, FIG. 18 illustrates a graph representing various quality factors FQ according to the amplitude of the oscillations of an oscillator and according to the spatial position of a watch fitted with an oscillator pivoted by two bearings like that illustrated in FIG. 7. It may be observed that these quality factors FQ are standardized whatever the position of the resonator, and significantly so by comparison with the quality factors FQ of a same resonator pivoted conventionally, which are depicted in FIG. 17.

The preload force F0 can be minimized as far as possible and according to the resonator chosen so as to optimize the energy required to sustain its oscillations. The minimum intensity of the force Fm is defined by the limit case in which the force Fi (F2 in FIG. 8) produced by one of the flexible blades is cancelled under the effect of the weight of the resonator (maximum 1 g of acceleration). Calculation shows that such a scenario can be achieved only if, at constant friction η:

F0>2.P/3 where P is the force exerted by the resonator on the bearing.

By respecting this criterion, F0 can be minimized as far as possible so as to produce the lowest possible static friction torque while at the same time balancing the friction torques in all the horizontal and vertical positions.

More particularly, the stiffness k of each of the flexible blades needs to meet the criterion:

k>2.P/(3.(rp-r0))

Whatever the alternative form from among the first two embodiments, the cross sections of these blades may or may not be constant. Each of these blades may also be made up of several blades, joined together or not, so as to optimize and differentiate their stiffnesses according to the various movements or positions of the resonator. For example, such an embodiment would make it possible to minimize the radial force of pressing against the shaft with a view to minimizing friction forces against the shaft while at the same time ensuring that the axis is centered in the bearing.

Whatever the alternative form from among the first two embodiments:

the blade or blades extend parallel or substantially parallel to the pressing elements in the vicinity of the pressing elements and/or orthogonally or substantially orthogonally with respect to the axis in the vicinity of the pressing elements, or the blade or blades extend perpendicularly or substantially perpendicularly with respect to the pressing elements in the vicinity of the pressing elements and/or orthogonally or substantially orthogonally with respect to the axis in the vicinity of the pressing elements.

Whatever the first and second embodiments, the blades, and more generally the bearings, may for example be made of nickel, a nickel-phosphorus alloy, or alternatively from silicon and/or coated silicon (silicon oxide, silicon nitride, etc.). Such components may preferably be manufactured by electroforming or by etching. Alternatively, such components could be machined by spark discharge machining.

Figure 14:
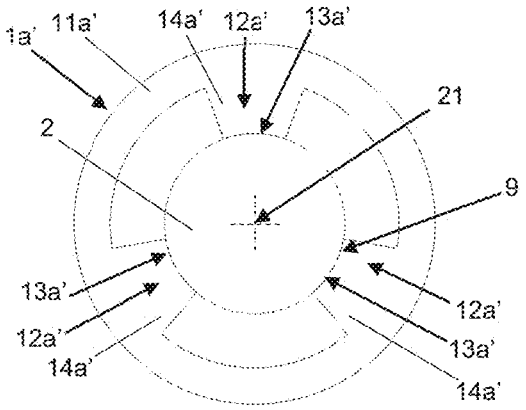
FIG. 14 is a face-on view of a first alternative form of a third embodiment of the guide bearing.
Figure 15:
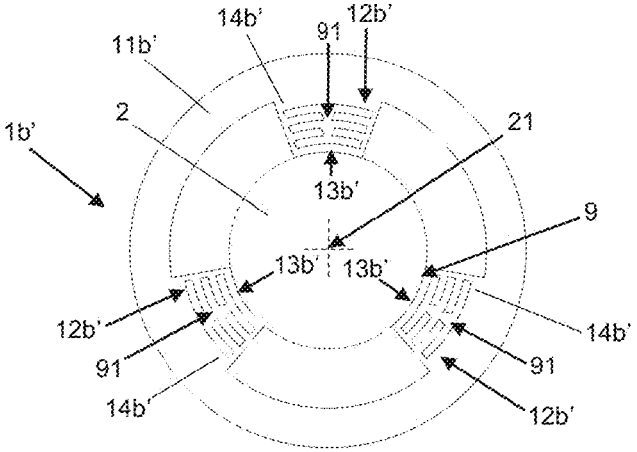
FIG. 15 is a face-on view of a second alternative form of the third embodiment of the guide bearing.
Figure 16:
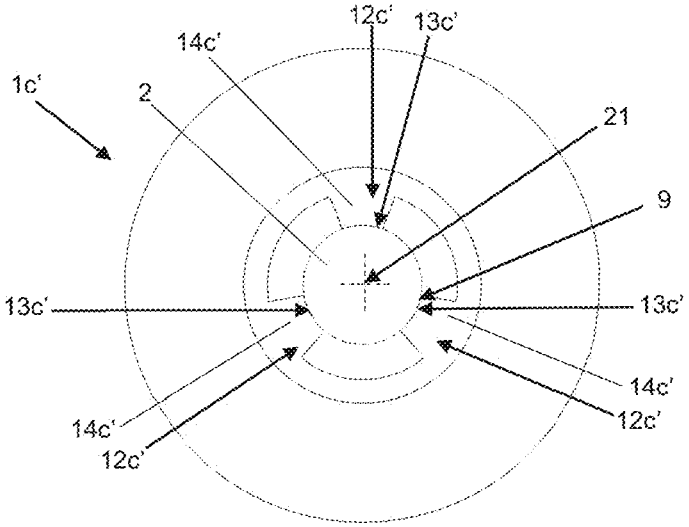
FIG. 16 is a face-on view of a third alternative form of the third embodiment of the guide bearing.

In a third embodiment described hereinafter with reference to FIGS. 14 to 16, the bearing comprises at least one radial or substantially radial protuberance 14*a*', 14*b*', each protuberance comprising:

at least one pressing element for pressing on the shaft, and a return element for returning at least one pressing element to press on the shaft.

Thus, for preference, the bearing comprises a ring exhibiting a geometry that includes several protuberances or lobes directed toward the axis of the ring, notably directed toward the axis of the ring and extending from a ring surface directed toward the inside of the ring. For preference, the ring comprises at least two protuberances. It may notably comprise two or three or four or five or six protuberances.

For preference, the bearing comprises a ring made of an elastomeric material. The bearing may be made of natural rubber or of synthetic rubber such as neoprene, polybutadiene, polyurethane or alternatively silicone.

As an alternative, the ring may exhibit a constant cross section. In that case, it may exhibit a pressing element comprising a continuous surface coming to press against the shaft on its entire circumference or on the majority of its circumference, for example more than 240° or more than 270° or more than 300°. In this alternative form, the bearing therefore comprises a single pressing element for pressing on the shaft. This pressing element consists of the surface in contact with the shaft. An annular part of the ring situated between the surface in contact with the shaft and the larger-diameter surface of the ring constitutes a return element, in this instance a single return element.

In a first alternative form of the third embodiment described hereinafter with reference to FIG. 14, the bearing 1*a*' comprises three protuberances 14*a*'. Each protuberance comprises a pressing element 13*a*' for pressing on the shaft and a return element 12*a*' for returning the pressing element into contact with the shaft. The pressing elements consist of surfaces of the protuberances in contact with the shaft. The return elements consist of the protuberance material connecting the pressing elements to the rest of the ring 11*a*' constituting a chassis and exhibiting a constant cross section. The protuberances are lobes or bosses filled with material.

In a second alternative form of the third embodiment described hereinafter with reference to FIG. 15, the bearing differs from the first alternative form of the third embodiment of the bearing in that the protuberances are lobes or bosses in which cuts 91 have been made. Thus, the bearing may comprise at least one radial or substantially radial protuberance, each protuberance comprising at least one pressing element for pressing on the shaft and one return element for returning at least one pressing element to press on the shaft, the return element or elements comprising cuts. A "cut" should be understood here as meaning any cavity which may notably have been produced by some technique other than by cutting, particularly by molding. These cuts 91 make it possible to adjust the stiffness of each of the protuberances.

In a third alternative form of the third embodiment described hereinafter with reference to FIG. 16, the bearing differs from the first alternative form of the third embodiment or from the second alternative form of the third embodiment in that the ring is mechanically connected to, notably fixed to, in particular overmolded on, a band 11*c*' constituting the chassis.

Whatever the embodiment and whatever the alternative form, the at least one return element and the at least one pressing element are preferably produced as one piece.

In the alternative forms and embodiments described, the bearing exhibits three return elements and three pressing elements. However, whatever the embodiment and whatever the alternative form, the bearing may exhibit a number of return elements other than three and a number of pressing elements other than three. In particular, whatever the embodiment and whatever the alternative form, the bearing may exhibit one or two or three or four or five or six return elements and one or two or three or four or five or six pressing elements. For preference, the bearing exhibits as many return elements as it does pressing elements.

Whatever the embodiment and whatever the alternative form, the pressing surface pressing against the shaft 2 of each pressing element may be planar or concave or convex. In particular, all the pressing surfaces may be planar or concave or convex.

Figure 12:
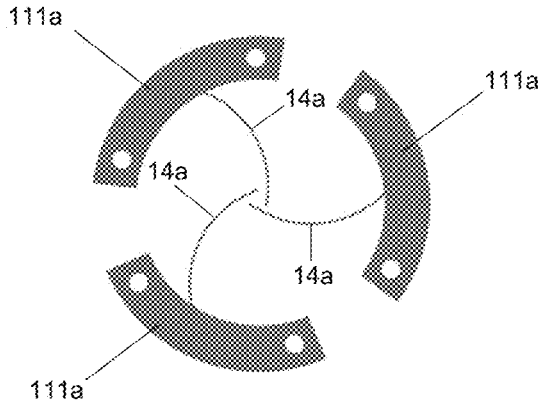

Whatever the embodiment and whatever the alternative form, the chassis, notably the annular chassis, may be manufactured as a single piece or produced in several independent components, notably in as many independent components as there are return elements. In the case where the blades are produced independently of one another, they are each fixed to a base 111*a*. The bases are advantageously provided with positioning elements and possibly with adjusting elements, notably with centering elements, such as holes. These positioning elements make it possible to define the axis of the bearing. Such an embodiment involving a base is depicted in FIG. 12. The positioning elements collaborate for example with pins.

Figure 11:
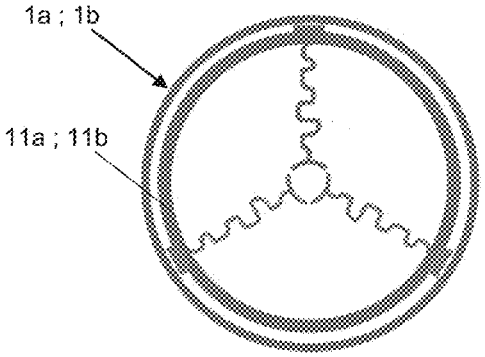
FIGS. 11 to 13 are schematic views illustrating overall bearing structures applicable in particular to the first embodiment of the guide bearing or to the second embodiment of the guide bearing.
Figure 13:
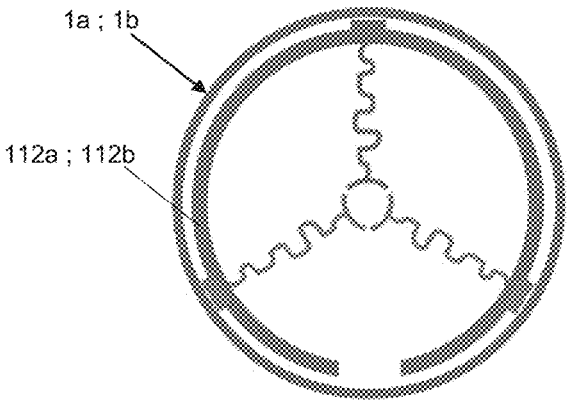

Whatever the embodiment and whatever the alternative form, the bearing may be provided with means of assembling the bearing. For example, the chassis may comprise a split ring, the split being there to allow it to deform elastically and thus allow the blades to be positioned suitably during assembly, as depicted in FIG. 13. The chassis may also comprise a continuous ring, as depicted in FIG. 11.

Whatever the embodiment and whatever the alternative form, the bearing may comprise bankings for limiting the deformation of the return elements.

Whatever the embodiment and whatever the alternative form, the pressing elements and/or the return elements are preferably uniformly angularly distributed about the axis 21.

The solutions described are aimed at overcoming the problem of the difference in running between positions by proposing a bearing configured in such a way as to generate a force that is essentially constant on a shaft of a resonator, whatever the position of the resonator. In order to achieve this, the bearing has the particular feature of being provided with at least one return means designed to apply a substantially radial force against a shaft of the resonator, and to do so irrespective of the position of the resonator.

The bearing is provided with at least one return means which is designed to apply a substantially radial force against the shaft so as to induce an essentially constant force between the shaft and the bearing, and to do so irrespective of the position of the watch.

In this way, the difference in running between positions is reduced to the strict minimum. Thus, the quality factor of the resonator can be constant or substantially constant irrespective of the position of the resonator, and the chronometric performance of the movement can be optimized.

The return means preferably has the function of supporting the shaft of the resonator and of positioning same, at least in the transverse plane of the bearing.

Whatever the embodiment, the bearing may be incorporated into a shock-absorber, notably into a shock-absorber of conventional structure.

In a shock-absorber according to the invention, it may be noted that an axial shock-absorbing function may be dissociated from the radial shock-absorbing function. Specifically, axial shock-absorbing is afforded chiefly by a conventional endstone jewel and a conventional anti-shock spring. A radial shock-absorbing function may be afforded by the bearings.

The invention claimed is:

1. A bearing for guiding a portion of a timepiece resonator shaft about an axis, comprising:

at least one blade extending toward the shaft; and each of the at least one blade having a pressing element on the respective end of the at least one blade that is configured to constantly exert an action on the shaft, radially or substantially radially with respect to the axis, wherein the pressing element is movable relative to the shaft, and wherein:

i) said at least one blade comprises a plurality of blades that extend from an inside surface of a chassis, with a proximal end of each blade connected to the chassis and with a distal free end of each blade being free and not connected to the chassis;

ii) wherein each blade is an elongated blade having a narrow cross-sectional width along at least a portion of the length of the blade providing flexibility in a widthwise direction lateral to the length of the blade;

iii) wherein the blades are uniformly angularly distributed around the axis, and wherein each blade has a like orientation with respect to a radial line extending from its respective proximal end to said axis; and iv) each blade including a shaft-side surface extending from the proximal end to the distal free end of the blade, with a distal region of the shaft-side surface constituting a pressing surface of said pressing element, wherein the pressing surface has a flat or concave region that contacts the shaft.

2. The bearing as claimed in claim 1, wherein each respective one of the at least one blade includes a respective return element that is connected to the respective pressing element, the respective return element being a portion of the respective at least one blade and collaborating with the respective pressing element.

3. The bearing as claimed in claim 2, wherein each respective one of the at least one return element and the respective pressing element are made as one piece.

4. The bearing as claimed in claim 1, wherein the at least one blade comprises at least two blades having at least two corresponding pressing elements for pressing on the shaft about the axis.

5. The bearing as claimed in claim 1, comprising at least two return elements and at least two pressing elements.

6. The bearing as claimed in claim 1, wherein each respective one of the at least one pressing element comprises at least one respective planar or concave or convex pressing surface.

7. The bearing as claimed in claim 5, comprising three return elements, and at least as many pressing elements.

8. The bearing as claimed in claim 6, wherein all the pressing surfaces are planar or concave or convex.

9. The bearing as claimed in claim 1, wherein each respective one of the at least one blade has:

a return element, constituted by the respective at least one blade, configured to return the at least one pressing element to press on the shaft.

10. The bearing as claimed in claim 9, comprising at least three blades.

11. The bearing as claimed in claim 9, wherein:

each of the at least one blade extends parallel or substantially parallel to the respective pressing element in a vicinity of the respective pressing element and/or orthogonally or substantially orthogonally with respect to the axis in the vicinity of the respective pressing element, or wherein each of the at least one blade extends at least substantially perpendicular to the respective pressing element in a vicinity of the respective pressing element and/or orthogonally or substantially orthogonally with respect to the axis in the vicinity of the respective pressing element.

12. The bearing as claimed in claim 9, wherein each of the at least one blade extends at least substantially in a straight line or wherein each of the at least one blade extends in curves.

13. The bearing as claimed in claim 1, wherein each of the at least one blade is one radial or substantially radial protuberance, the protuberance comprising:

at least one pressing element for pressing on the shaft, and a return element for returning the at least one pressing element to press on the shaft.

14. The bearing as claimed in claim 1, comprising:

an annular chassis, each of the at least one pressing element being mechanically connected to the chassis via at least one return element, and bankings limiting a deformation of the at least one return element, further comprising:

the annular chassis being a single piece, and/or the annular chassis being several independent components, and/or the annular chassis being in as many independent components as there are return elements wherein the at least one pressing element and/or at least one return element includes a plurality of pressing elements and/or a plurality of return elements that are uniformly angularly distributed about the axis.

15. A shock-absorber comprising a bearing as claimed in claim 1 and an endstone jewel.

16. A horology mechanism comprising a shock-absorber as claimed in claim 15 and a shaft mounted in the bearing, wherein each of the at least one pressing element presses directly on the shaft.

17. The horology mechanism as claimed in claim 16, which is a balance oscillator.

18. The mechanism as claimed in claim 16, wherein the mechanism comprises a resonator comprising a balance, and/or wherein the mechanism comprises a resonator of which a shaft portion or pivot-shank is guided by the bearing, and/or wherein each of the at least one return element is preloaded.

19. A horology movement comprising a mechanism as claimed in claim 16.

20. A timepiece comprising a movement as claimed in claim 19.

21. The bearing as claimed in claim 1 in combination with a timepiece resonator shaft, wherein the at least one pressing element presses directly on the shaft.

22. The bearing as claimed in claim 1, wherein the at least one blade includes a plurality of blades, and wherein each of the plurality of blades is configured to independently move relative to one another.

23. The bearing as claimed in claim 1, wherein said at least one blade includes three blades.

24. A bearing for guiding a portion of a timepiece resonator shaft about an axis, comprising:

a plurality of blades extending toward the shaft, said blades being fixed to a chassis at a proximal end of the blade and extending to a free distal end of the blade;

wherein each blade is an elongated blade having a narrow cross-sectional width along at least a portion of the length of the blade providing flexibility in a widthwise direction lateral to the length of the blade with the free distal end of the blade moving relative to the fixed proximal end of the blade;

each of the plurality of blades having a pressing element at the free distal end of the blade that is arranged to exert an action on the shaft, radially or substantially radially with respect to the axis, wherein the pressing element is movable relative to the shaft;

wherein each pressing element includes a concave shaft-side surface configured to surround a portion of the shaft;

wherein said concave shaft-side surface is formed from each pressing element having an arcuate surface with a radius of curvature that surrounds said portion of the shaft or from each pressing element having a banking or hook that extends towards the shaft.

25. A bearing for guiding a portion of a timepiece resonator shaft about an axis, comprising:

a plurality of blades extending toward the shaft, said blades being fixed to a chassis at a proximal end of the blade and extending to a free distal end of the blade;

wherein each blade is an elongated blade having a narrow cross-sectional width along at least a portion of the length of the blade providing flexibility in a widthwise direction lateral to the length of the blade with the free distal end of the blade moving relative to the fixed proximal end of the blade;

each of the plurality of blades having a pressing element at the free distal end of the blade that is arranged to exert an action on the shaft, radially or substantially radially with respect to the axis, wherein the pressing element is movable relative to the shaft; and each of said plurality of blades including a shaft-side surface extending to a distal free end of the blade, with a distal region of the shaft-side surface constituting a pressing surface of said pressing element, and wherein all of said plurality of blades extend such as to spiral towards an axis of said shaft, with all of said plurality of blades spiraling in a common direction.

* * * * *